United States Patent [19]

Janssen et al.

[11] 4,438,917

[45] Mar. 27, 1984

[54] DUAL MOTOR ALIGNER

[75] Inventors: Donovan M. Janssen; John P. Mantey; Donald C. Roller, all of Boulder; Lance A. Walker, Longmont, all of Colo.

[73] Assignee: International Business Machines Corporation, Armonk, N.Y.

[21] Appl. No.: 311,837

[22] Filed: Oct. 16, 1981

[51] Int. Cl.[3] ..... B65H 9/20

[52] U.S. Cl. ..... 271/227; 198/394; 198/395; 271/261

[58] Field of Search ..... 271/227, 228, 37, 38, 271/113, 119, 120, 110, 111, 260, 261, 10; 198/434, 394, 395

[56] References Cited

U.S. PATENT DOCUMENTS

| | | | |
|---|---|---|---|
| 3,065,835 | 11/1962 | Drillick | 271/227 X |
| 3,240,487 | 3/1966 | Templeton | 271/228 X |
| 3,603,446 | 9/1971 | Maxey et al. | 271/227 X |
| 3,743,277 | 7/1973 | Schunemann . | |
| 3,754,826 | 8/1973 | Kobayashi et al. . | |
| 3,774,192 | 11/1973 | Boulter | 271/260 X |
| 3,817,515 | 6/1974 | Kanda . | |
| 4,082,456 | 4/1978 | Schroter | 271/227 X |
| 4,089,516 | 5/1978 | Colglazier et al. | 271/37 X |
| 4,089,517 | 3/1978 | Marass | 271/227 X |
| 4,216,482 | 8/1980 | Mason | 271/227 X |

FOREIGN PATENT DOCUMENTS

| | | |
|---|---|---|
| 1465983 | 3/1977 | United Kingdom . |
| 2063830 | 6/1981 | United Kingdom . |

OTHER PUBLICATIONS

Janssen, D. M. et al. *IBM Technical Disclosure Bulletin,* vol. 22, No. 11, Apr. 1980, pp. 4847–4848.

*Primary Examiner*—Bruce H. Stoner, Jr.
*Assistant Examiner*—L. Rosenberg
*Attorney, Agent, or Firm*—C. E. Rohrer; J. G. Cockburn

[57] ABSTRACT

A device for feeding sheets from a supply station aligning the sheets in an X, Y and $\theta$ coordinates and then gating the sheet into a work station such as the transfer station of a copier. The device includes a pair of independently servo-controlled motors disposed on opposite sides of the sheet. Each motor drives a nip roller which transports the copy sheet. Sensors are disposed to generate signals representative of sheet position in the X, Y and $\theta$ coordinates. A controller uses the signals to adjust the angular velocity of the motor so that the sheet is squared and is gated onto the work station. The sensors and controller are utilized to measure different parameters associated with the sheet.

7 Claims, 8 Drawing Figures

DUAL MOTOR ALIGNER

BACKGROUND OF THE INVENTION (1) Field of the Invention

The present invention relates to sheet feeding devices in general, and in particular, devices which align and gate sheets into a work station.

(2) Prior Art

The use of sheet feeding devices for feeding sheets into timed relationship or synchronization with a relatively moving processing station is well known in the prior art. Such devices consist of a paper path extending from a sheet supply bin into the processing station. A sheet transport device is disposed within the paper path. A lateral edge aligner and a gate mechanism are usually disposed at appropriate zones of the paper path. The edge aligner is usually a flat surface against which the sheet is referenced to achieve lateral alignment. Gating and forward alignment (that is alignment in the direction of sheet motion) are achieved by registering the sheet against the gate mechanism. The gate mechanism generally runs transversely to the direction of sheet travel.

Although the above devices work well for their intended purpose, they are affected by several undesirable features. Usually, these devices require relatively long paper paths in order to perform the lateral and forward sheet alignment. The long paper path tends to increase the overall size and cost of the machine. Also scuffing the sheets against the alignment edge and gate mechanism results in damage to the sheet and creates paper dust.

U.S. Pat. No. 3,065,835 describes a high speed printing device and a drive mechanism for positioning a sheet relative to the printing device. The drive mechanism consists of eight drive nips disposed in orthogonal arrangements along the paper path of said device. Each drive nip is formed by a drive roller and a back-up roller. Four of the drive nips are utilized to position the sheet bidirectionally along the X axis. Likewise, the other four drive nips position the sheet bidirectionally along the Y axis. Each sheet has a preprinted grid pattern on one side. Sensors which are placed in the paper path sense the grid pattern and adjust the motor/brake assembly associated with the nips so that the sheet is advanced to successive printing positions.

U.S. Pat. No. 3,754,826 describes a drive mechanism which automatically corrects the orientation of a document so that the document is positioned in proper orientation to the document glass of a copier. The drive mechanism consists of a vacuum transport belt and a pair of switches disposed on a line normal to the direction of sheet travel. When the sheet is properly oriented, both sensors are activated simultaneously. When the sheet is not properly oriented, one of the sensors is picked before the other. The time lag between the actuation of the switches indicates skew and activates a system which adjusts the orientation of the belt to compensate for skew in the sheet.

U.S. Pat. Nos. 3,743,277 and 4,089,517 describe prior art devices which utilize sensors to sense the lateral position of a sheet and activate a positioning device to correct lateral offset.

Although the latter-cited prior art devices are an improvement over the previously mentioned devices which utilize gating and side registration members, the latter devices tend to be complex and do not perform all the necessary functions needed to align and gate a sheet into a work station.

SUMMARY OF THE INVENTION

It is a general object of the present invention to provide a sheet handling device which is more efficient than has heretofore been possible.

The device includes a paper supply tray and a sheet conveying path which interconnects the tray with a processing station. A pair of sheet sensing devices are set crosswise to the direction of a sheet traversing the paper path. A pair of drive nips transport paper along the path. Each drive nip includes a back-up roll and a drive roll. Each drive roll is driven by an independently controlled servo motor. As a sheet traverses the paper path, the sensor generates electrical signals representative of the actual time when the sensors are picked. The electrical signals are substituted into a plurality of stored algorithms to generate a series of derived times. By varying the velocity of the servo motors in accordance with a predetermined velocity profile and the derived times, the skew, lateral misalignment (that is misalignment along the Y axis) and gating adjustment are achieved.

In one feature of the invention a rotary shingler feeds sheets at an angle from the top of the stack into the feed nips.

In another feature of the invention the sensors are disposed on a line which is inclined to the direction of sheet travel.

The foregoing and other objects, features and advantages of the invention will be apparent from the following more particular description of a preferred embodiment of the invention, as illustrated in the accompanying drawings.

DETAILED DESCRIPTION OF THE PREFERRED EMBODIMENT

The paper handling device to be described hereinafter finds use in any environment where it is required to align a sheet and feed the sheet in timed relationship with a process station of a utilization device. Since the device works well to gate a sheet of paper into the transfer station of a convenience copier, it will be described in this environment. However, this should not be construed as a limitation on the scope of the invention since it is the intention to adapt the invention for use other than positioning paper at the work station of a duplicator, copier, printer, etc. In addition to feeding and aligning, the invention to be described can be utilized for measuring various parameters such as skew, lateral misalignment, X position, velocity, etc. associated with a sheet as it traverses a paper path.

The present invention to be described in detail hereinafter utilizes two independently servo-controlled motors and a plurality of sensors to feed, align and gate a sheet of paper to be in alignment with a latent image disposed on the photosensitive surface of a convenience copier. Paper is fed from a supply drawer at an initial skew angle. Two sensors are used to measure the initial skew angle. One of the sensors is used to establish the lateral paper position based on when the paper clears the sensor. Based on the timing information from the two sensors, the angular velocities of the drive motors are controlled such that the skew angle ($\theta$) and lateral (Y) errors are reduced to zero. Furthermore, longitudinal or forward position (X) is known so that gating into the transfer station is also accomplished by these two drive motors.

Figure 1:
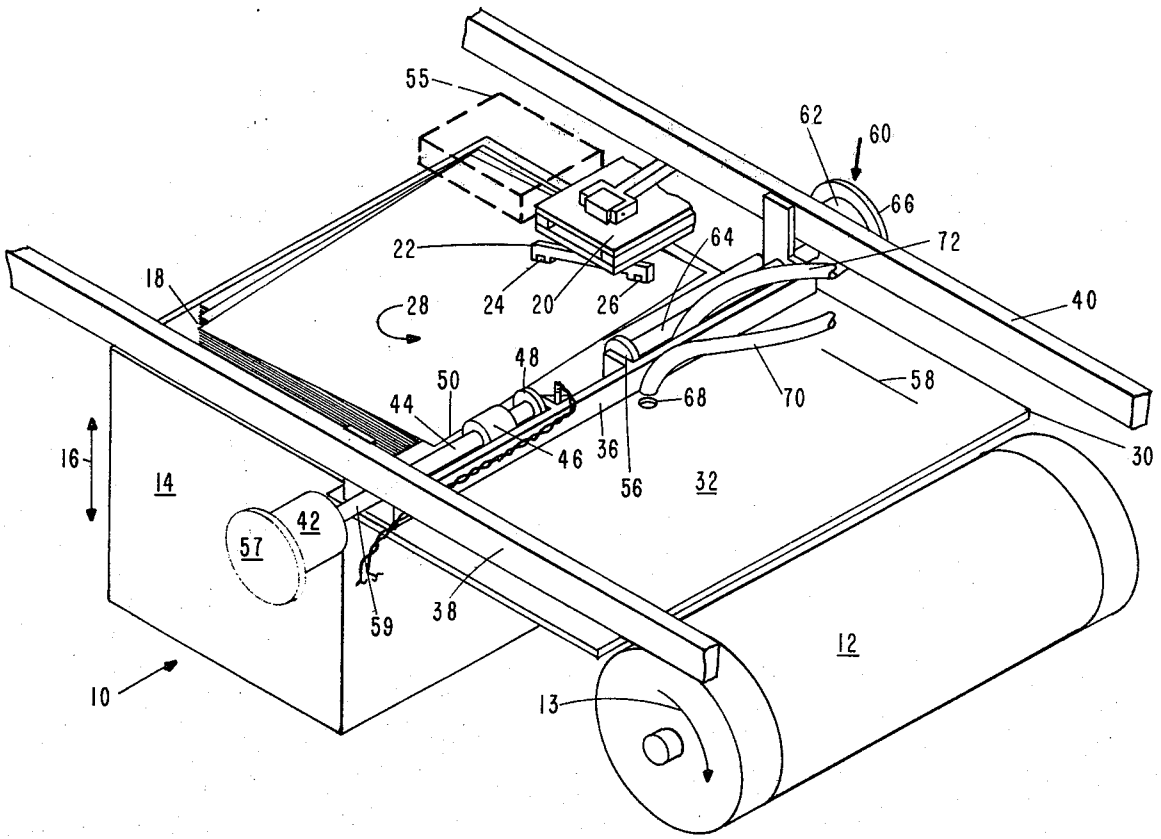
FIG. 1 shows a pictorial view of a sheet aligning mechanism according to the teaching of the present invention.

FIG. 1 shows a pictorial view of the sheet handling device 10 disposed relative to the photoconductive drum 12 of an electrophotographic copier. The sheet handling apparatus 10 is disposed at the transfer station of the electrophotographic copier. The processing stations associated with electrophotographic copiers are well known in the art and, as such, details of the stations and configurations will not be described. Suffice it to say that a plurality of conventional processing stations (not shown) are disposed about the periphery of photoconductor drum 12. The station includes a charging station whereat a uniform electrical charge is deposited on the photosensitive surface of drum 12. As the drum rotates in a clockwise direction identified by numeral 13 from the charging station, it accesses the imaging station whereat a latent image of a document is deposited on the drum. The drum next accesses the developer station wherein a microscopic toning powder such as toner is used to develop the latent image on the drum to a visible one.

The drum next accesses the transfer station whereat the sheet handling device 10 feeds a sheet so that it aligns or coincides with the toned image on the photoconductor drum. With the paper in contact with the drum, the toned image is transferred to the paper. The paper is next fused and is outputted in an exit tray. In the meantime the photoconductor accesses a cleaning station where it is cleaned, and the process is again repeated.

As mentioned previously, the function of sheet handling apparatus 10 is to remove sheets in sequential order from a paper stack, align the sheets in the $\theta$, Y and X coordinates (FIG. 1) and then gate the sheet into proper timed relationship with the position of the toned image on the rotating drum. The sheet handling apparatus 10 includes a paper supply tray 14. The paper supply tray 14 includes an adjustable bottom (not shown) which can be adjusted in the direction identified by double-headed arrow 16. As such, as paper is removed from stack 18 and the stack height changes, the bottom is adjusted to position the topmost sheet on the stack in contact with sheet separating means 20. Although a plurality of devices can be used for separating the sheet from stack 18, in the preferred embodiment of this invention, sheet separating means 20 is the so-called rotary shingler. The rotary shingler includes an elongated member 22. A plurality of free-rolling members 24 and 26 are mounted to the extremity of the elongated member. The rotary shingler is driven so that the elongated member and its attached free-rolling wheels move downward onto the stack and in a circular direction shown by numeral 28. As the free-rolling members contact the stack, sheets are separated or fanned out from the stack at an initial angle. As the topmost sheet is removed from the stack, a sheet restraining device 55 restrains the other sheets.

Still referring to FIG. 1, a paper transport path identified by numeral 30 interconnects the output from paper supply tray 14 to the transfer station. The paper transport path includes a lower guide plate 32 and an upper guide plate (not shown). In the preferred embodiment of this invention, the upper guide plate is fabricated from wires. Of course other types of upper guide plates can be used without deviating from the scope of this invention. A support bracket 36 is mounted to run transversely to the paper transport path 30. The extremity of the support bracket is coupled to frame members 38 and 40, respectively. The frame members form the frame which supports the various elements of the sheet handling apparatus 10.

Figure 2:
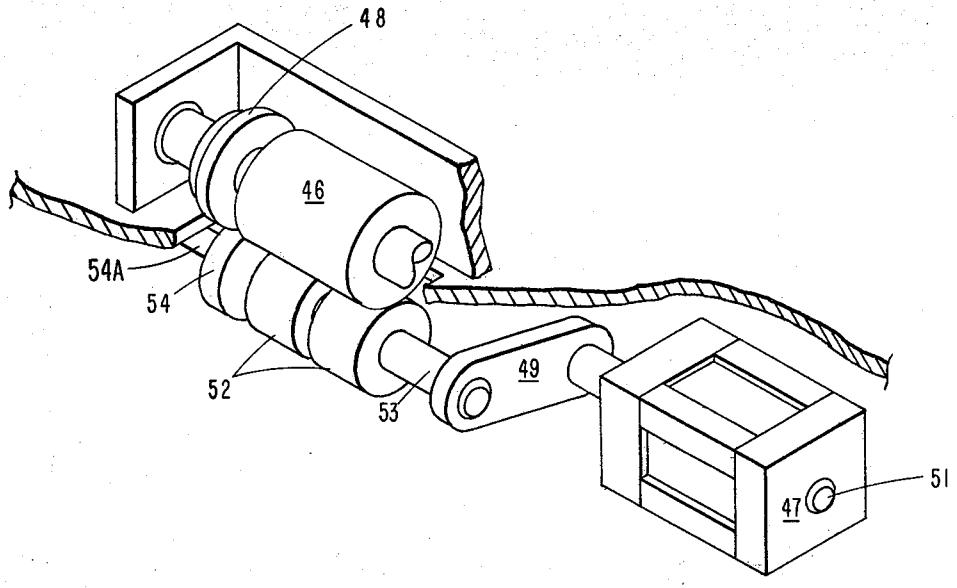
FIG. 2 shows a view of the feed nip used to feed sheets.

A DC servo-controlled motor 42 is mounted to support bracket 36. A motor shaft 44 extends outwardly from the DC motor. The motor is mounted so that the shaft runs transversely to the lower guide plate 32. A pair of drive rollers 46 and 48 are mounted to shaft 44. The outer surface area of drive roller 46 is substantially greater than that of drive roller 48. As will be described subsequently, the wide surface area on drive roller 46 is utilized for pulling a sheet from bin 14 after the leading edge 50 of the sheet is positioned between the feed nip formed by drive roller 46 and an adjustable back-up roller 52 (FIG. 2). Turning to FIG. 2 for the moment, the adjustable roller 52 is coupled to an actuating mechanism which moves the roller in a plane perpendicular to the surface of drive roller 46. As such, when edge 50 (FIG. 1) of a sheet is positioned within the nip, the actuating mechanism is activated and the back-up roller 52 moves up and forms the drive nip which pulls the sheet from the tray. In the preferred embodiment of this invention the actuating mechanism is a motor 47. A rigid oval-shaped coupling arm 49 interconnects the output motor shaft 51 with shaft 53. The back-up roller 52 is mounted on shaft 53. When the motor is energized, back-up roller 52 coacts with drive roller 46 to form a feed nip. Since the feed nip is relatively wide, the sheet does not deviate (that is change) from its inital skew angle. As soon as the leading edge of the sheet reaches a predetermined distance, the motor 47 is deenergized. This allows the back-up roller 52 to move away from drive roller 46.

The feeding and aligning of the sheet is now performed by drive rollers 48 and 56, respectively. A spring-biased back-up roller 54 mounted on shaft 54A coacts with feed roller 48 to feed the sheet. In a similar manner, a back-up roller, not shown, but identical to roller 54, coacts with drive roller 56 to propel the sheet along the paper transport path 30. To summarize, the feed nip formed between feed roller 46 and adjustable back-up roller 52 pulls the topmost sheet from tray 14. When the sheet is moved a predetermined distance downstream, the adjustable back-up roller is moved away from drive roller 46 and the sheet is propelled along the path by drive roller 48 and drive roller 56, respectively.

Still referring to FIG. 1, a position encoder 57, hereinafter referred to as a tachometer, is mounted to the motor 42. As will be described hereinafter, the function of the tachometer is to measure the angular position and the direction in which motor 42 is rotating. As such, the tachometer is a two-phase tach. The utilization of tachometers for generating signals indicative of the angular position and direction of the motor rotation is well known in the prior art and, as such, details of tachometer 57 will not be given.

Transportation of the sheet along the paper transport path 30 is effectuated by the drive nips formed by drive rollers 48 and 56, respectively. A second independently controlled drive means 60 is disposed on the opposite side of the paper transport path 30. The second independently controlled drive means 60 is disposed in linear but spaced alignment from the first independently controlled drive means 59. The components of the second independently controlled drive means 60 are substantially identical to those of the first independently controlled drive means 59. As such, details of the components will not be given. Suffice it to say that the second independently controlled drive means 60 includes a DC servo-controlled motor 62, a drive shaft 64 which extends from the motor, and a feed roller 56 is mounted to the motor shaft. The direction of rotation and angular position are generated by tachometer 66.

A pair of sensing devices (only one of which is shown in FIG. 1) and identified by numeral 68 is disposed within the paper transport path 30. The function of the sensing devices is to sense the presence or absence of a sheet as it is transported along the paper path. Although a plurality of conventional sensors, such as optical sensors, etc., can be used as a sensing device, in the preferred embodiment of this invention, the sensing devices are pneumatic sensors. The sensors are mounted in the paper path so that a line interconnecting the centers of the sensors is inclined (that is disposed at an angle) to scribe line 58. It should be noted at this point, that scribe line 58 is an imaginary line against which a sheet is squared before it is gated onto photoconductor drum 12. Stated another way, all misalignment parameters are referenced relative to scribe line 58. Pneumatics for the paper sensors are supplied through tubes 70 and 72, respectively.

Figure 6:
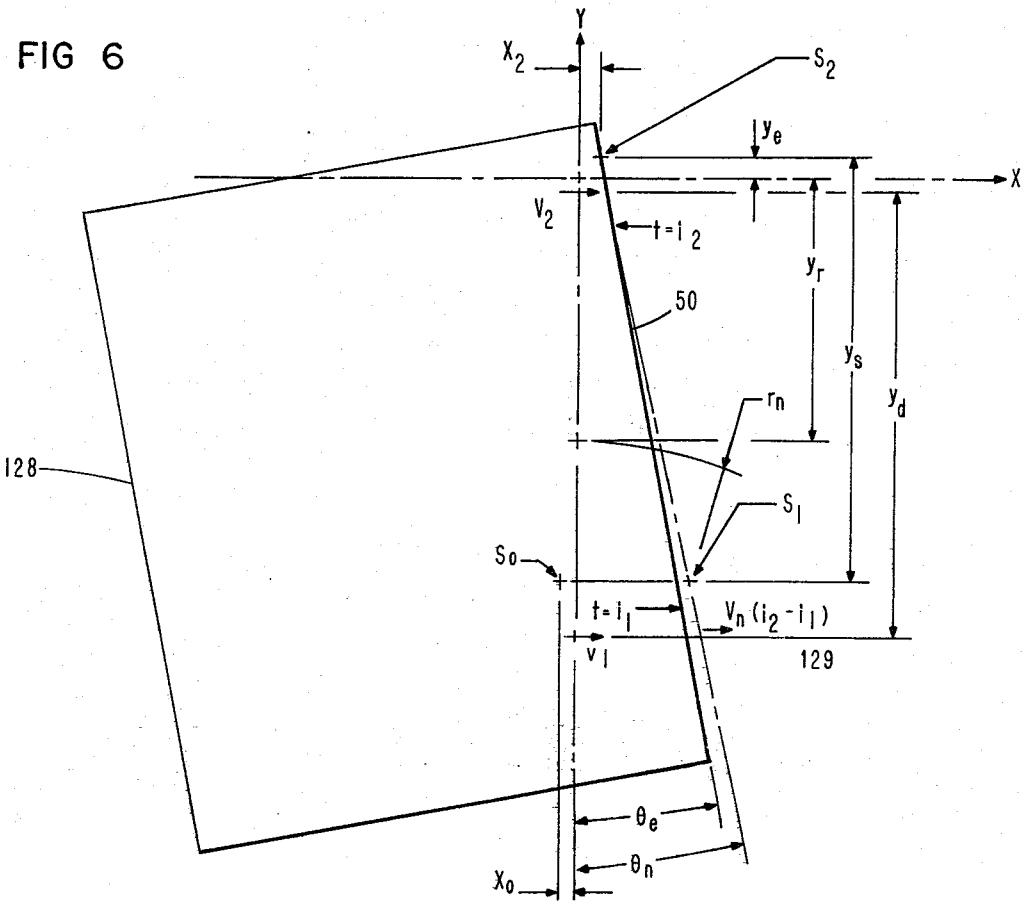
FIG. 6 shows the geometry of the sheet as it enters the aligner and shows the nomenclature of the aligner's geometry.

In operation, a stack of sheets is loaded onto paper supply tray 14. Rotary shingler 20 is positioned so that free-rolling elements 24 and 26 contact the topmost sheet and shingle the same at an initial angle from the stack. The leading edge 50 of the sheet activates sensor $S_0$ (FIG. 6). As soon as sensor $S_0$ is activated, a signal is generated which removes the shingler 20 from contacting the stack. As the shingler is removed, the restraining device 74 (FIG. 7) contacts the stack to prevent movement of other sheets from the stack. At this point in the feed cycle, the leading edge 50 of the shingled sheet now sits in line with feed roller 46 (FIG. 1). The adjustable back-up roller 52 (FIG. 2) is activated and moves upwardly to clamp the sheet between its surface and that of feed roller 46. Servo-controlled motor 42 is activated and, as such, the sheet is fed out into paper transport path 30. The back-up roller 52 (FIG. 2) is now deactivated and the sheet is now driven along the paper path by the drive nip formed by drive rollers 48, 56 and their respective back-up rollers. The sensors $S_1$ and $S_2$ (FIG. 6) are utilized to sense the leading edge and the side edge of the shingled sheet and a controller adjusts the velocity of the servo motors 42 and 62 so that the skew, Y and X misalignment associated with the sheet is corrected. The sheet is now in edgewise alignment with line 58 and it is then gated by the feed nips onto drum 12.

Figure 7:
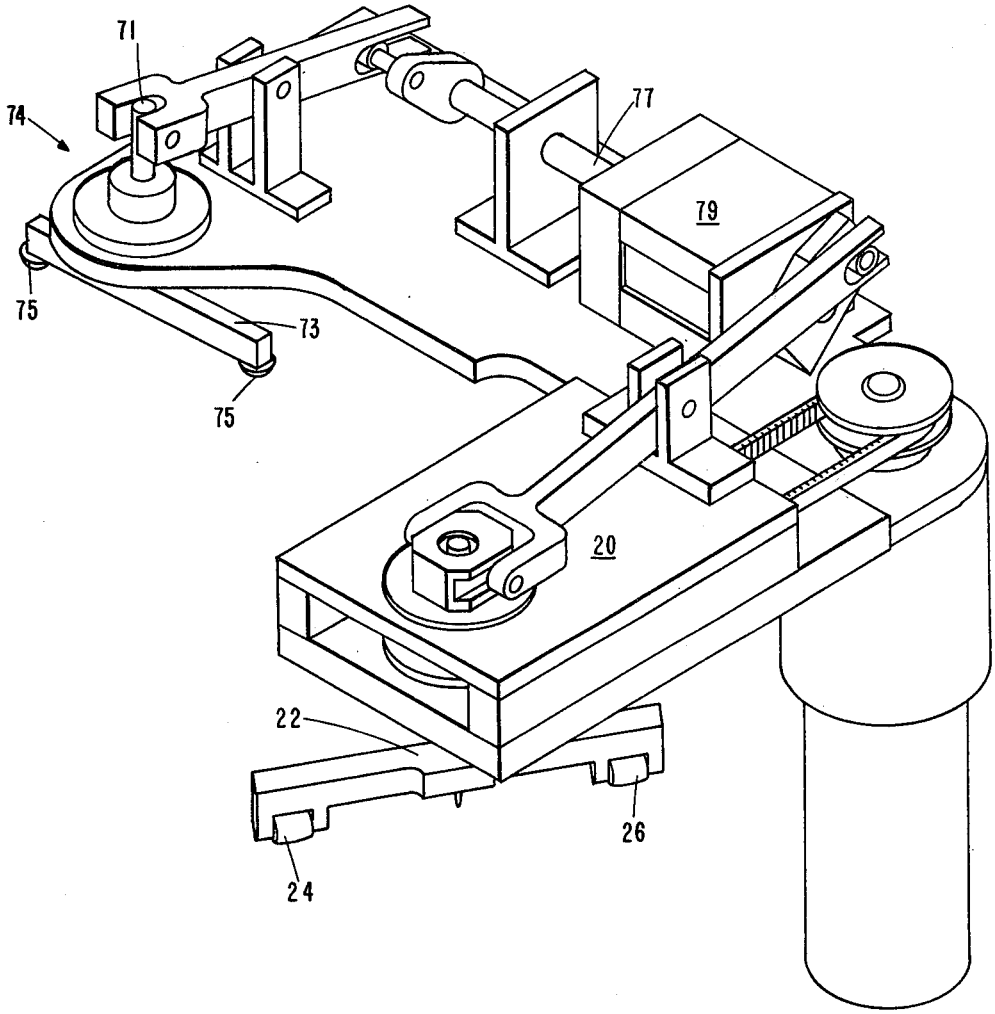
FIG. 7 shows an isometric view of a sheet shingling sheet restraining device.

As can be seen from FIG. 7, the restraining device 74 works synchronously with shingling device 20 to assure that as the topmost sheet is fed from the stack, the other sheets are restrained to the stack. The restraining device 74 includes an elongated member identified by numeral 73. A pair of rubber-like pads 75 are mounted to each end of the elongated member. The elongated member is firmly attached to shaft 71. The shaft is coupled by mechanical couplings to shaft 77 of drive motor 79. Similarly, the elongated member 22 of shingler 20 is coupled to shaft 77 as the restraining device makes contact with the stack when the shingler does not, and vice versa.

Figure 4:
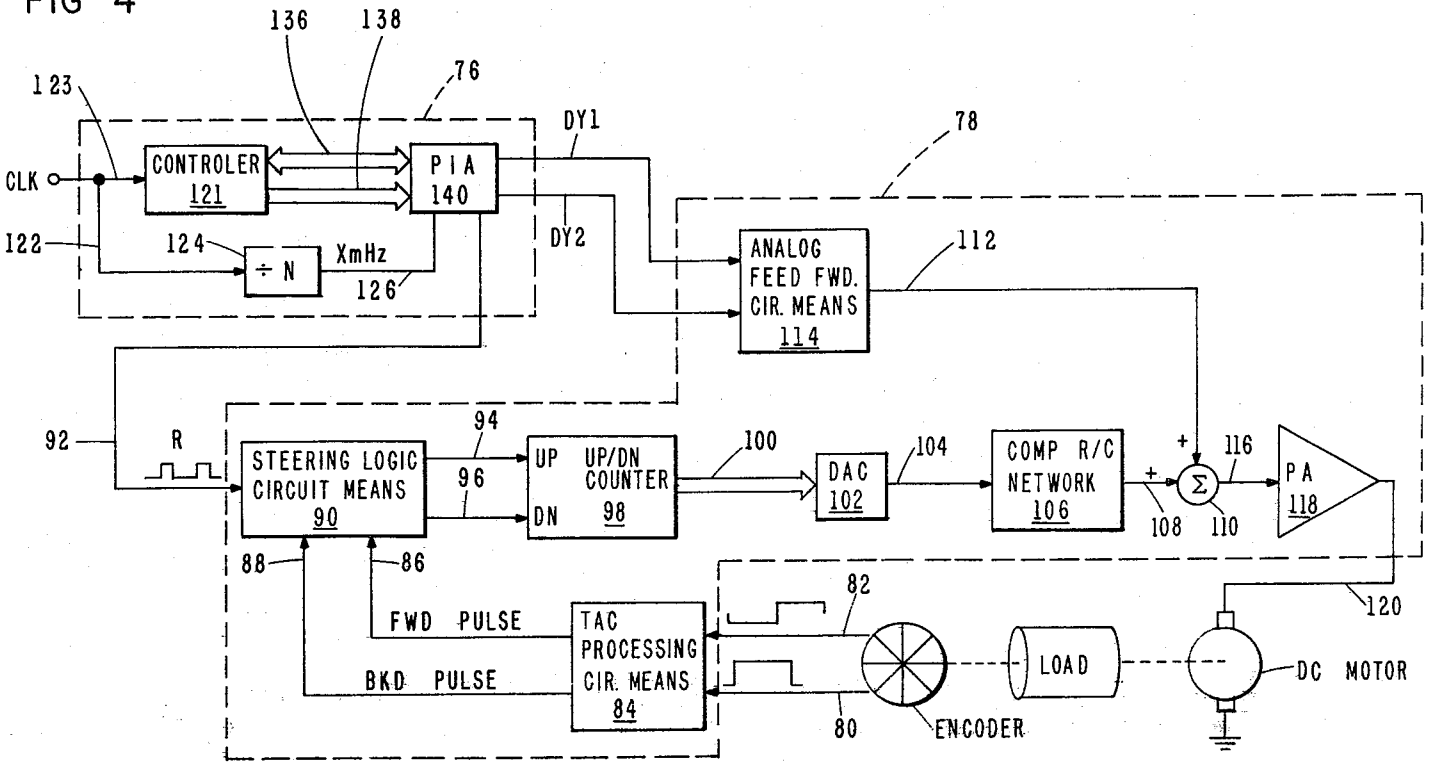
FIG. 4 shows a block diagram of the controller and electrical circuits for driving the motors.

FIG. 4 shows a block diagram of a control means which is used to drive each of the motors in FIG. 1. The control means includes a control system 76 and a servo loop 78. The function of the control system 76 is to store a velocity profile representative of the velocity with which each motor should be driven and to calculate certain timing parameters in accordance with certain stored algorithms or expressions. The stored expressions, calculated time and the velocity profile will be described in detail hereinafter. The function of servo loop 78 is to control the motor so that the paper is aligned and gated onto the photoconductor drum of FIG. 1. Before describing the detail of the controller system and the servo loop, it should be noted that each of the motors 42 and 62 (FIG. 1) is driven by an independently controlled servo loop such as 78. Since the electronic circuitry in both loops are substantially identical, only one of the loops will be described in this application, it being understood that each motor is driven by separate loops, and as such, the feed nip associated with each motor can be independently controlled to correct skew, lateral and forward misalignment associated with the sheet.

In FIG. 4 the servo loop 78 is coupled to one of the DC motors 42 and 62. The load which is shown in FIG. 4 is symbolic of the paper drive nip, etc., which are coupled to the motors 42 and 62, respectively. The encoder which is coupled to either motor is a two-phased tachometer. The function of the two-phased tach is to measure position and direction of rotation of the motor. Two similar but out-of-phase signals are outputted from the tach on conductors 80 and 82, respectively. Tach processing circuit means 84 is coupled to conductors 80 and 82, respectively. The function of tach processing circuit means 84 is to accept the out-of-phase signal and to generate backward and forward pulses therefrom. The generated pulses are transmitted over conductors 86 and 88 into steering logic circuit means 90. Several conventional circuit means are available for performing the function of tachometer processing circuit means 84. As such, details of this circuit will not be given. By way of example, *IBM Technical Disclosure Bulletin* Vol. 14, No. 12, May 1972 (pgs. 3672–3673) describes a circuit means which is suitable for processing the signal outputted from the two-phased tachometer.

Similarly, the function of the steering logic circuit means 90 is to synchronize the reference clock pulse (R) on conductor 92 with the pulses on conductors 86 and 88, respectively. The output from steering logic circuit means 90 is on conductors 94 and 96, respectively. As was stated previously, the control system 76 outputs reference pulses which are utilized for driving the motor at certain velocities. These reference pulses are derived from the velocity profile chart which is stored in the microprocessor. Following synchronization, the pulse on conductor 94 is utilized for counting up/down counter 98 upward and the pulse on conductor 96 is utilized for counting the counter downward. The signal from the up/down counter is fed over conductor 100 into a digital-to-analog converter (DAC) 102. The function of the DAC is to convert the digital signals into analog signals. The analog signals from the DAC are fed over conductor 104 into compensating R-C network 106. The compensating R-C network 106 is a conventional network whose function is to adjust the gain and other variables associated with the servo loop. The output from the compensating R-C network is fed into summing circuit means 110 over conductor 108. Another signal into summing circuit means 110 is supplied by conductor 112. The signal on conductor 112 is generated by the analog feed forward circuit means 114. The function of the analog feed forward circuit means 114 is to accept signals generated by the controller system 76 on conductor DY1 and DY2 and to output an appropriate signal depending on the code which is generated on these two input conductors.

The analog feed forward circuit means 114 includes a plurality of analog switches. The switches are activated by the digital pulses outputted from the control system and to output feed forward signals on conductor 112. The output from summing circuit means 110 is outputted on conductor 116. The signal on conductor 116 is fed into power amplifier (PA) 118 where it is amplified and fed over conductor 120 to drive the DC motor. The feed forward loop 114 forms the greater part of the energization current for the motor. The closed-loop section of the servo loop, including the tach processing circuit means, the steering logic circuit means, the R-C network, etc. merely fine tunes the motor current so that the motor is accurately controlled.

Still referring to FIG. 4, the control system 76 includes a controller 121 and a peripheral interface adapter (PIA) 140. The PIA 140 outputs control signals on dynamic line 1 (DY1) dynamic line 2 (DY2) and reference pulses (R) on conductor 92. The PIA 140 is coupled to controller 121 over address buss 138, while a data buss 136 interconnects the PIA and controller 121. A clock signal for energizing the controller 121 is supplied on conductor 123. The clock signal on conductor 123 is fed over conductor 122 into a divide by N circuit means 124. The output from the divide by N circuit means 124 is a series of clock pulses having a frequency x megahertz (x MHz) which is outputted on conductor 126. The conductor 126 interconnects the divide by N circuit means 124 and the PIA 140.

Although a plurality of discrete circuits may be utilized as controller 121, in the preferred embodiment of this invention controller 121 is a microcomputer. More particularly, the M68000 microcomputer manufactured by Motorola Inc. was utilized. This computer is a conventional microcomputer and, as such, details will not be given. The clock pulse on conductor 123 which drives the M68000 is an eight megahertz clock. The value for N in circuit means 124 is eight and the value of x on conductor 126 is one megahertz. Similarly, the use of PIA modules for interfacing microcomputer with external circuits are well known in the art and, as such, details of the PIA 140 will not be given. Suffice it to say that the PIA includes a plurality of timers, registers, counters, etc. which are addressed over buss 138 by the microcomputer and data to and from the PIA and the microcomputer is transferred over bidirectional buss 136.

Microcomputer 121 includes a velocity profile which is utilized to drive each of the motors in FIG. 1. In the preferred embodiment of this invention, the velocity profile is in the form of tachometer pulses which are stored in a random access memory or read only storage in the microcomputer. At the appropriate time in the machine cycle, the values are extracted from the table and are fed over the peripheral interface adapter (PIA) 140 as reference pulses on conductor 92. Similarly, to control the velocity of each motor so as to perform the skew adjustment, lateral, etc. associated with the paper sheet, the microcomputer selectively energizes the lines identified as DY1 and DY2 which feed into analog feed forward circuit means 114. The energization is in accordance with the following table.

TABLE I

| STATES | DY1 | DY2 |
|---|---|---|
| Stop | 1 | 1 |
| Accelerate | 0 | 1 |
| Run | 0 | 0 |
| Decelerate | 1 | 0 |

As can be seen from the above table a motor can operate in one of four states; namely, the motor can be stopped; accelerated, run, which means the motor is moving at steady state or it can decelerate. By assigning the digital values which are shown in the table to lines DY1 and DY2, the motor is forced into one of the selected states. By way of example, at the beginning of a cycle where the motors are starting from rest, the code 01 is outputted on DY1 and DY2 respectively. This means a high amount of energy would be forced into the motor and the velocity would keep changing until it reached steady state or run cycle. At this point the microcomputer assigns the code 00 to the lines DY1 and DY2, respectively. Each of the codes will activate the appropriate switch on analog feed forward circuit means 114. As the switches are activated, the proper amount of current is metered out to the motor.

In addition to the velocity profile algorithm which is stored in the microcomputer, a second set of expressions or algorithms are also stored. Each of the expressions relate to a specific time when certain functions must be performed. Before disclosing the second set of expressions, it is worthwhile examining the position of the paper as it is transported from the supply tray until it is gated onto the photoconductor drum in FIG. 1. Also, the velocity profile which is utilized to drive each of the motors to attain the proper positioning of the sheet will be given. Essentially the theory of control is that the two sensors previously described generate three independent times identified as $i_1$, $i_2$ and $i_3$ in FIGS. 3A and 3B. These timing signals are utilized to position the sheet at the transfer station with the correct alignment $(Y,\theta)$ and timing (X,T).

Figure 3A:
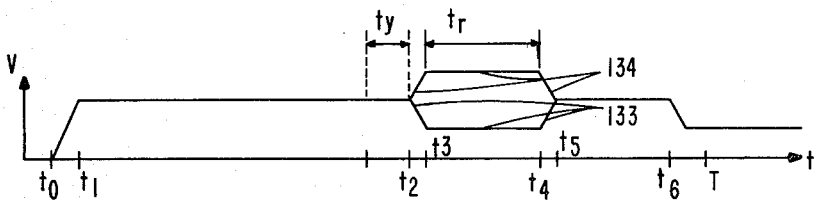
FIGS. 3A and 3B show a plot of the velocity/timing signals which is supplied to the nip roller motors. This graph is helpful in understanding the invention.
Figure 3B:
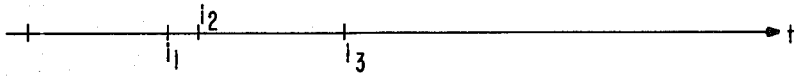
Figure 5:
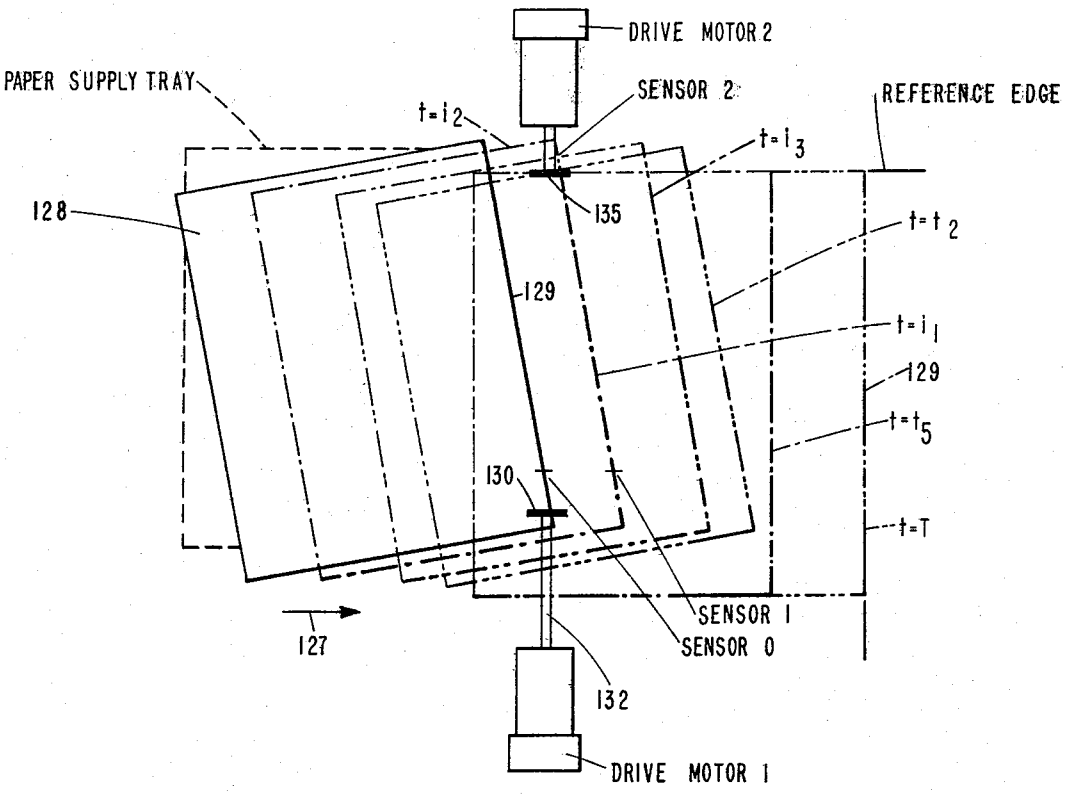
FIG. 5 shows various positions of the sheet as it moves from the supply stack to a transfer or processing station.

Referring now to FIGS. 3A, 3B and 5, a schematic of the velocity profile, paper tray and the paper path 127 are shown. The sketch shows various positions of the sheet 128 as it is transported along the paper path from the supply stack to the transfer station. t represents the time when certain edges of the paper are positioned at certain points along the paper path. Sensors 1 and 2 ($S_1$ and $S_2$) represent the previously described sensors, while sensor 0 ($S_0$) is utilized to control the lowering and raising of picker assembly 20 (FIGS. 1, 6 and 7) relative to the stack. By way of example, as soon as the leading edge 129 of sheet 128 intercepts sensor 0, a signal is generated which raises the arm from the stack and delays shingling of another sheet. When $t=i_1$ sensor 1 is picked (that is the leading edge of the sheet crosses sensor 1); when $t=i_2$ sensor 2 is picked; when $t=i_3$ the edge of the sheet clears sensor 2. Of course three sensors could be used to obtain this information.

It should also be noted that the reference edge (FIG. 5) is an imaginary line which is parallel to the sheet paper path. Likewise, the drive nip associated with drive motor 1 (FIG. 5) is formed by drive roller 130 which coacts with a back-up roller (not shown) and is coupled to drive motor 1 by shaft 132. Likewise, the second drive nip is formed by the drive roller 135 and a back-up roller (not shown). Likewise, $t=t_5$ represents the time when the sheet is properly aligned with the paper path and $t=T$ represents the time when the sheet attaches to the photoconductor. It should be noted that at $t_5$ the position of the sheet can be timed relative to the photoconductor since the distance from the nips relative to the position of the photoconductor is known.

FIG. 6 shows a sketch of the aligner geometry. This geometry is utilized to generate the second set of algorithm or equations which are stored in the microprocessor. From this second set of equations, the values for $t_y$, $t_r$ and $t_6$, FIG. 3A, are generated. FIG. 3B shows the timings ($i_1$, $i_2$ and $i_3$) which are utilized from the sensors. With reference to FIG. 6, it should be noted that the paper is fed into the aligner at an angle. $\theta_e$ represents the initial feed angle while $\theta_n$ represents the nominal skew angle. X represents the x coordinate while Y represents the y coordinate. $S_0$, $S_1$ and $S_2$ represent the sensors. Of course, $S_0$ signals are utilized for controlling the shingler, while $S_1$ and $S_2$ are utilized to control the positioning of the sheet.

With reference to FIG. 3A, the velocity profile which is utilized for driving the motor is shown. The theory behind the motor control is that the value for the velocity is generated by the microprocessor by interrogating the data stored in the first set of algorithms previously described. By varying the time over which the known velocity profile is supplied to the motor, the motor is used to adjust and correct the dimensional misalignments associated with the sheet. By way of example, and still referring to FIG. 3A, between time $t_0$ and $t_1$, the motors identified in FIG. 5 as drive motor 1 and drive motor 2 or in FIG. 1 as 42 and 62 are accelerated so that the velocity increases to a steady state value. Between time $t_1$ and $t_2$ the motors are running at steady state. Time $i_1$ and $i_2$ (FIG. 3B) represents the time when the sensor 1 and sensor 2 are picked. FIG. 5 shows the approximate orientation of the sheet as the sensors are picked. At $i_3$ the edge of the sheet crosses sensor 2 for the second time. The time from $i_3$ to $t_2$ (FIGS. 3A and 3B) is identified as $t_y$. This $t_y$ time is identified as the time before correction begins. As will be pointed out hereinafter, $t_y$ is one of the times which has to be calculated. After the expiration of $t_y$ time, the acceleration applied to each motor changes. The acceleration which applies to drive motor 1 (FIG. 5) or drive motor 42 (FIG. 1) is identified by curve 133. Similarly, the velocity profile applied to drive motor 62 (FIG. 1) or drive motor 2 (FIG. 5) is identified by curve 134. Curve 134 which is applied to drive motor 62 (FIG. 1) or drive motor 2 (FIG. 5) has an acceleration portion, a steady state portion and a deceleration portion.

Similarly, the velocity profile 133, which is applied to the other motor, has a deceleration portion, a constant velocity portion and an acceleration portion. By applying different velocities to each of the motors, the net result is that the motor identified by numeral 62 in FIG. 1 or drive motor 2 in FIG. 5 is driving its associated nip at a faster rate than the other motor, and as such, the sheet is turning and Y alignment, together with skew correction is achieved. The critical time for this operation is $t_r$. As such, $t_r$ is represented by one of the stored expressions.

At $t_5$ (FIGS. 3A and 3B), the sheet is squared (FIG. 5) and both motors are running again at steady state. At time $t_6$, both motors are decelerated until they are running at the velocity $v_p$. In the preferred embodiment of this invention, $v_p$ is a processing velocity of the photoconductor drum. As such, gating onto the drum at time T is achieved. The other time of value which is stored in the microprocessor is $t_6$ time. The values for $t_y$, $t_r$ and $t_6$ were derived theoretically from the geometry of the paper as is shown in FIG. 6.

As such, the expression for $t_r$, $t_y$ and $t_6$ are as follows:

$$t_r = A(i_2 - i_1) + B,$$

$$t_y = C(i_2 - i_1)^3 + D(i_2 - i_1)^2 + E(i_2 - i_1) + F$$

$$t_6 = G(i_3 - i_2) + Ht_r + It_y + Jt_r^2 + Kt_r(i_3 - i_2) + Lt_rt_y + Mt_r^3 + Nt_r^2(i_3 - i_2) + Pt_r^2t_y + Q.$$

The values for $i_1$, $i_2$ and $i_3$ are obtained from the times when the paper accesses the sensors previously described in the paper path. These times are recorded by the microcomputer. The value of the constant A, B, C, D, E, F, G, H, I, J, K, L, M, N, P and Q are obtained theoretically based on the geometry of the paper path. These values are stored in the microprocessor and the microprocessor utilizes the value of the stored constant together with time $i_1$, $i_2$ and $i_3$ to calculate the needed values of $t_r$, $t_y$ and $t_6$. Once these values are calculated, the microprocessor interrogates the velocity profile and generates the velocity pulses for the time calculated.

As was stated previously, these values are derived based upon the geometry of the sheet as it is transferred through the paper path. By way of example and with reference to FIG. 6, the following calculation derives the expression for $t_r$.

Correction along the y coordinate takes place as the sheet initially moves through the aligner. With reference to FIG. 6, the correction is expressed as:

$$y_e = v_n(i_3 - i_2) \sin \theta_e \cos \theta_e \quad (1)$$

where $y_e$ represents correction in the y coordinate, $v_n$ represents the transport velocity, $\theta_e$ represents the initial feed angle.

Note that this correction takes place because the sheet enters the aligner at a skewed angle and the correction takes place passively. After sensor two reappears ($i_3$) a fixed amount of y correction always remains which allows the $\theta$ correction to take place while still obtaining the proper lateral position.

The initial entry angle can vary due to variations in the sheet separation process (shingling). From sensors $S_1$ and $S_2$, timings $i_1$ and $i_2$ are generated which determine the entry angle. Based on the entry geometry (FIG. 6), $$\sin(\theta_e - \theta_n) = \frac{v_n(i_2 - i_1)}{y_s} \cos\theta_n \cos\theta_e \quad (2)$$

or $$\theta_e \sim \theta_n + \frac{v_n(i_2 - i_1)}{y_s} \cos^2\theta_n \quad (3)$$

where $\theta_n$ is the sensor angular orientation and $y_s$ the sensor separation.

A change in the entry angle will take place whenever there is a differential velocity between the two drive motors. We will now derive these relationships which exist between the sheet skew and the drive motor velocities.

For the time period $t_2$–$t_3$ (FIG. 3A) we have $$v_1 = v_n - a(t - t_2) \quad (4)$$

and $$v_2 = v_n + a(t - t_2) \quad (5)$$

Where a is the drive nip acceleration and $v_1$ and $v_2$ the drive nips velocities. The instantaneous radius ($r_n$) of the sheet (FIG. 6) is $$r_n = v_n/\omega = \frac{y_d v_n}{v_2 - v_1} \quad (6)$$

where $v_2/r_2 = v_1/r_1 = \omega$ and $r_2 - r_1 = y_d$ is used to obtain (6). The negative sign on $\omega$ arises because, as $\theta$ is defined, a positive velocity generates a decreasing $\theta$.

Combining (4), (5) and (6) yields $$r_n(t) = \frac{y_d v_n}{2a(t - t_2)} \quad (7)$$

Noting that in general $$d\theta = \omega\, dt \text{ or } = -\frac{v_n}{r_n}\, dt \quad (8)$$

so the angular position after the initial acceleration period is $$\theta(t_3) = \theta_e - \int_{t_2}^{t_3} \frac{2a(t - t_2)}{y_d}\, dt \quad (9)$$

or $$\theta(t_3) = \theta_e - \frac{a}{y_d} t_a^2 \quad (10)$$

where $t_a = t_3 - t_2$

For the time period $t_3$–$t_4$ (FIG. 3A)

$$v_1 = v_n - at_a \quad (11)$$

and $$v_2 = v_n + at_a \quad (12)$$

thus $$r_n = \frac{y_d v_n}{2at_a} \quad (13)$$

and $$\theta(t_4) = \theta(t_3) - \int_{t_3}^{t_4} \frac{2at_a}{y_d}\, dt \quad (14)$$

or using $t_r \equiv t_4 - t_3$ $$\theta(t_4) = \theta(t_3) - \frac{2at_a t_r}{y_d} \quad (15)$$

And finally for the time period $t_4$–$t_5$ (FIG. 3A)

$$v_1 = v_n - at_a + a(t - t_4) \quad (16)$$

and $$v_2 = v_n + at_a - a(t - t_4) \quad (17)$$

thus $$r_n = \frac{y_d v_n}{2a[t_a - (t - t_4)]} \quad (18)$$

and $$\theta(t_5) = \int_{t_4}^{t_5} -\frac{2a(t_a - t + t_4)}{y_d}\, dt + \theta(t_4) \quad (19)$$

Again using $t_a = t_5 - t_4$ $$\theta(t_5) = -\frac{a}{y_d} t_a^2 + \theta(t_4) \equiv 0 \quad (20)$$

or using (15) and (10)

$$\theta_e = 2\frac{a}{y_d} t_a(t_r + t_a) \quad (21)$$

Since the acceleration time $t_a$ is given, the only unknown in (21), is $t_r$ i.e., $$t_r = \frac{\theta_e y_d}{2at_a} - t_a \quad (22)$$

By substituting (3) into (22) we obtain the following expression:

$$t_r = \left\{ \theta_n + \frac{v_n}{y_s} \cos^2\theta_n(i_2 - i_1) \right\} \frac{y_d}{2at_a} - t_a \quad (23)$$

The only variables in (23) are $i_1$ and $i_2$. The other elements (such as $\theta_n$, $v_n$, $y_s$, etc.) in (23) are constant for a paper path having a particular geometry. As such (23) may be rewritten as follows:

$$t_r = A(i_2 - i_1) + B \quad (24)$$

-continued where $$A = \frac{v_n y_d}{2at_a y_s} \cos^2\theta_n$$

$$B = \frac{\theta_n y_d}{2at_a} - t_a$$

It should be noted that (24) is now in a form which can be easily calculated by a conventional microcomputer.

By a similar arithmetic calculation, the values for $t_y$ and $t_6$ are obtained. Since the calculations for $t_y$ and $t_6$ are within the skill of the art, details will not be given.

OPERATION

The function of the dual motor aligner previously described is to feed paper from the supply drawer while simultaneously aligning the paper in the y and $\theta$ coordinates and then gating the sheet into the transfer station. Aligning takes place by entering the aligner at an angle $\theta$ (FIGS. 1 and 5) and then controlling two independent drive motors 42 and 62 (FIG. 1). By transporting at an initial skew angle, compensation for lateral (Y) position error takes place. Then by establishing a differential velocity between the two drive motors, the sheet is squared with respect to the transfer station. Using the position information from the drive motor tachometers, the sheet is gated into the transfer station.

One advantage which enures to the user of this apparatus is the use of a single device for feeding sheets from the paper drawer, aligning and gating into a processing station.

A second advantage is that the transport distance between the paper drawer and the transfer station is relatively short and straight.

Yet another advantage is that the sheet is not scuffed along a reference nor crashed into a mechanical gate; thus reduction in edge damage and paper dust is achieved,. Also, due to the rapidity with which the sheet can be aligned and gated onto the photoconductor, when used in a copier no interimage gap is required between sheets.

While the invention has been particularly shown and described with reference to a preferred embodiment thereof, it will be understood by those skilled in the art that various changes in form and details may be made therein without departing from the spirit and scope of the invention.

What is claimed is:

1. A sheet handling device for adjusting sheet position prior to entering said sheet into the sheet processing station of a utilization apparatus, said device capable of adjusting said sheet position (1) for skew misalignment, (2) for lateral (side) edge misalignment, and (3) for adjusting sheet speed to that desired for entry into the processing station and for timing the entry of the leading edge of the sheet into the processing station at a desired time, comprising:

a sheet entry station;

a sheet transport path coupling said sheet processing station with said entry station;

independently controlled drive means disposed within said transport path, a first one of such drive means located adjacent a first edge of said transport path and a second one of such drive means located adjacent the opposite edge of said transport path, said drive means for moving said sheet along said transport path to said sheet processing station from said entry station;

signal generating means disposed within said transport path for sensing sheet position; and control means responsive to said signal generating means for adjusting the speed of said independently controlled drive means to correct sensed positional misalignment of said sheet for skew misalignment, lateral edge misalignment and for timing the entry of the leading edge of said sheet into said sheet processing station at a desired speed.

2. The sheet handling device of claim 1 wherein said signal generating means includes a first sheet sensing means located adjacent a first edge of said sheet transport path and a second sheet sensing means located adjacent the opposite edge of said sheet transport path, the two sheet sensing means for detecting the passage of the leading edge of said sheet and generating first and second signals in response thereto;

said control means including processor means for calculating the skew angle of said sheet from the time differential between said first and second signals and for calculating a time period during which the speed of said first drive means is greater than the speed of said second drive means to remove said skew angle and thereby square said leading edge to the direction of movement; and said control means further including command means and power means, said command means for acting upon said calculated time period to command said power means to adjust the speed of said drive means to accomplish the removal of said skew angle.

3. The sheet handling device of claim 2 wherein said processor means includes means for calculating a first point in time at which the speed of said drive means must be operated at a specific desired speed to move the leading edge of said sheet into said sheet processing station at a desired entry time; and said command means further including means for acting in response to said first point in time to command said power means for adjusting the speed of said drive means to accomplish said entry into said sheet processing station at the desired time.

4. The sheet handling device of claim 2 wherein said signal generating means includes means for sensing the side edge of said sheet and generating a third signal indicative of side edge position;

said processor means for calculating a second point in time at which to begin said time period during which the speed of the first drive means is greater than the speed of the second drive means; and said command means further including means for acting in response to said second point in time for commanding said power means to adjust the speed of said drive means for said time period, at the end of which said side edge is at the desired location, said second point in time occurring prior to said first point in time.

5. The sheet handling device of claim 4 wherein said sheet is deliberately entered into said sheet transport path at a skew angle by said sheet entry station.

6. The device of claim 2 wherein said signal generating means includes means for sensing the side edge of said sheet and generating a third signal indicative of side edge position;

said processor means for calculating a specific point in time at which to begin said time period during which the speed of the first drive means is greater than the speed of the second drive means; and said command means further including means for acting in response to said specific point in time for commanding said power means to adjust the speed of said drive means for said time period, at the end of which said side edge is at the desired location.

7. The device of claim 6 wherein said sheet is deliberately entered into said sheet transport path at a skew angle by said sheet entry station.

* * * * *